US012760431B2

(12) United States Patent
Dinca et al.

(10) Patent No.: US 12,760,431 B2
(45) Date of Patent: Oct. 13, 2026

(54) METAL-ORGANIC FRAMEWORK ON GAS DIFFUSION ELECTRODE

(71) Applicant: Massachusetts Institute of Technology, Cambridge, MA (US)

(72) Inventors: Mircea Dinca, Belmont, MA (US); Ruperto Mariano, Somerville, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 960 days.

(21) Appl. No.: 17/828,646

(22) Filed: May 31, 2022

(65) Prior Publication Data

US 2022/0396887 A1 Dec. 15, 2022

Related U.S. Application Data

(60) Provisional application No. 63/208,991, filed on Jun. 10, 2021.

(51) Int. Cl.

| | |
|---|---|
| ***C25B 11/032*** | (2021.01) |
| ***C25B 1/30*** | (2006.01) |
| ***C25B 11/048*** | (2021.01) |

(52) U.S. Cl.

CPC ..... *C25B 11/032* (2021.01); *C25B 1/30* (2013.01); *C25B 11/048* (2021.01)

(58) Field of Classification Search

CPC ..... C25B 3/25–3/26; C25B 11/032

See application file for complete search history.

(56) References Cited

U.S. PATENT DOCUMENTS

2020/0131649 A1* 4/2020 Krause ..... C25B 11/031

OTHER PUBLICATIONS

Miner et al ("Modular O2 electroreduction activity in triphenylene-based metal-organic frameworks", Chem. Sci., 2018, 9, 6286 (Year: 2018).*

Jahan et al ("A Graphene Oxide and Copper-Centered Metal Organic Framework Composite as a Tri-Functional Catalyst for HER, OER, and ORR", Adv. Funct. Mater. 2013, 23, 5363-5372) (Year: 2013).*

Furukawa et al ("The Chemistry and Applications of Metal-Organic Frameworks", Science 341, 1230444 (2013)) (Year: 2013).*

Xing et al ("Enhancing carbon dioxide gas-diffusion electrolysis by creating a hydrophobic catalyst microenvironment", Nature Communications, vol. 12, Article No. 13, Jan. 8, 2021). (Year: 2021).*

Art Xing et al ("Enhancing carbon dioxide gas-diffusion electrolysis by creating a hydrophobic catalyst microenvironment", Nature Communications, vol. 12, Article No. 13, Jan. 8, 2021) (Year: 2021).*

Nguyen et al ("Gas diffusion electrode design for electrochemical carbon dioxide reduction", Chem. Soc. Rev., 2020, 49, 7488-7504). (Year: 2020).*

(Continued)

*Primary Examiner* — Alexander W Keeling

(74) *Attorney, Agent, or Firm* — Schmeiser Olsen, PLLC

(57) ABSTRACT

An electrode with a gas diffusion electrode (GDE) layer and a metal-organic framework (MOF) layer. The electrode overcomes mass transport limits by providing a gas diffusion pathway to conductive MOF electrodes. At the same applied potential, this translates to a tenfold improvement in current density (greater than 100 mA $cm^{-2}$) relative to conventional conductive MOF electrode geometries (less than 1 mA $cm^{-2}$).

20 Claims, 10 Drawing Sheets

(56) References Cited

OTHER PUBLICATIONS

Kharod, et al. "Teaching Metal-Organic Frameworks to Conduct: Ion and Electron Transport in Metal-Organic Frameworks," Mar. 23, 2022, The Annual Review of Materials Research, pp. 5.1-5.26.
Siahrostami, et al. "Enabling direct H2O2 production through rational electrocatalyst design," Nov. 17, 2013, Nature Materials, vol. 12, pp. 1137-1144.
Siahrostami, et al. "A Review on Challenges and Successes in Atomic Scale Design of Catalysts for Electrochemical Synthesis of Hydrogen Peroxide," Jul. 7, 2020, ACS Catalysis, vol. 10(14).
Miner, et al. Electrochemical oxygen reduction catalysed by Ni3(hexaiminotriphenylene)2, Mar. 8, 2016, Nature Communications.
Xie, et al., "Electrically Conductive Metal-Organic Frameworks," 2020, Chemical Reviews, vol. 120, pp. 8536-8850.
Miner, et al., "Modular O2 electroreduction activity in triphenlyene-based metal-organic frameworks," 2018, Chemical Science, vol. 9, pp. 6286-6291.
Park, et al. "A review of gas diffusion layer in PEM fuel cells: Materials and designs," Feb. 6, 2012, International Journal of Hydrogen Energy 37, pp. 5850-5865.
Zhong, et al. "Phthalocyanine-based Layers Two-Dimensional Conjugated Metal-Organic Framework as Highly Efficient Electrocatalyst for Oxygen Reduction Reaction," Jun. 2019, Angewandte Chemie International Edition, 58, pp. 10677-10682.
Chen, et al. "Continuous Electrical Conductivity Variation in M3(Hexaiminotriphenylene)2 (M = Co, Ni, Cu) MOF Alloys," Jun. 12, 2020, Journal of the American Chemical Society, 142, pp. 12367-12373.
Ripatti, et al. "Carbon Monoxide Gas Diffusion Electrolysis that Produces Concentrated C2 Products with High Single-Pass Conversion," Joule, 3, pp. 240-256.
Chen, et al. "Developement of a reactor with carob catalysts for modular-scale, low-cost electrochemical generation of H2O2," 2017, Reaction Chemistry and Engineering, 2, 239-245.
Lange, Jean-Paul "Performance metrics for sustainable catalysts in industry," Mar. 2021, Nature Catalysts, vol. 4, pp. 186-192.
Campbell, et al. "Cu3(hexaiminotriphenylene)2: An Electrically Conductive 2D Metal-Organic Framework for Chemiresistive Sensing," 2015, Angewandte Chemie International Edition, 54, pp. 4349-4352.
Lian, et al. "Unpaird 3d Electrons on Atomically Dispersed Cobalt Centres in Coordination Polymers Regulate both Oxygen Reduction Reaction (ORR) Activity and Selectivity for Use in Zinc-Air Batteries," 2020, Angewandte Chemie International Edition, 59, pp. 286-294.
Yang, et al., "Role of the Carbon-Based Gas Diffustion Layer on Flooding in a Gas Diffusion Electrode Cell for Electrochemical CO2 Reduction," 2021, ACS Energy Letters, 6, pp. 33-40.
Xing, et al. "Enhancing carbon dioxide gas-diffusion electrolysis by creating a hydrophobic catalyst microenvironment," 2021, Nature Communications, 12.
Xia, et al. "Direct electrosynthesis of pure aqueous H2O2 solutions up to 20% by weight using a solid electrolyte," Oct. 11, 2019, Science, 366, pp. 226-231.
Park, et al. "Cation-Dependent Intrinsic Electrical Conductivity in Isostructural Tetrathiafulvalene-Based Microporous Metal-Organic Framworks," Jan. 18, 2015, Journal of American Chemical Society, 137, pp. 1774-1777.
Miner, et al. "Modular O2 electroreduction activity in triphenylene-based metal-organic frameworks," 2018, Chemical Science, 9, pp. 6286-6291.

* cited by examiner

- 0.1 mg cm$^{-2}$ $Ni_3(HITP)_2$
- 0.2 mg cm$^{-2}$ $Ni_3(HITP)_2$
- 0.4 mg cm$^{-2}$ $Ni_3(HITP)_2$
- 0.8 mg cm$^{-2}$ $Ni_3(HITP)_2$

METAL-ORGANIC FRAMEWORK ON GAS DIFFUSION ELECTRODE

CROSS-REFERENCE TO RELATED APPLICATIONS

This application claims priority to and is a non-provisional of U.S. Patent Application 63/208,991 (filed Jun. 10, 2021), the entirety of which is incorporated herein by reference.

STATEMENT OF FEDERALLY SPONSORED RESEARCH OR DEVELOPMENT

This invention was made with government support under DMR-1645232 awarded by the National Science Foundation (NSF). The government has certain rights in the invention.

BACKGROUND OF THE INVENTION

Powering chemical synthesis with renewable electricity is critical for decarbonization, and this requires the discovery of efficient electrocatalysts. Additionally, achieving high current densities is crucial to the translation of electrocatalyst materials for industrial electrosynthesis.

Electrosynthesis reactions that involve gaseous species have rates that are limited by multiple factors, including the solubility of the gas(es) and the rate of mass transport. While attempts have been made to increase the reaction rates using various mechanisms (e.g. porous electrodes), additional mechanisms are still desired.

The discussion above is merely provided for general background information and is not intended to be used as an aid in determining the scope of the claimed subject matter.

SUMMARY

This disclosure provides an electrode with a gas diffusion electrode (GDE) layer and a metal-organic framework (MOF) layer. The electrode overcomes mass transport limits by providing a gas diffusion pathway to conductive MOF electrodes. At the same applied potential, this translates to a tenfold improvement in current density (greater than 100 mA $cm^{-2}$) relative to conventional conductive MOF electrode geometries (less than 1 mA $cm^{-2}$).

In a first embodiment, an electrode is provided. The electrode comprising: a gas diffusion electrode layer with a top surface and a bottom surface; and a metal-organic framework layer contiguous with the top surface.

In a second embodiment, a method for performing electrolysis is provided. The method comprising: introducing a gaseous substrate into an electrochemical cell; providing electricity to the electrochemical cell, wherein the electrochemical cell comprises: a first electrode comprising (1) a gas diffusion electrode layer with a top surface and a bottom surface; and (2) a metal-organic framework layer contiguous with the top surface; a second electrode; and a liquid electrolyte solution, the gaseous substrate being dissolved in the liquid electrolyte solution.

This brief description of the invention is intended only to provide a brief overview of subject matter disclosed herein according to one or more illustrative embodiments and does not serve as a guide to interpreting the claims or to define or limit the scope of the invention, which is defined only by the appended claims. This brief description is provided to introduce an illustrative selection of concepts in a simplified form that are further described below in the detailed description. This brief description is not intended to identify key features or essential features of the claimed subject matter, nor is it intended to be used as an aid in determining the scope of the claimed subject matter. The claimed subject matter is not limited to implementations that solve any or all disadvantages noted in the background.

BRIEF DESCRIPTION OF THE DRAWINGS

So that the manner in which the features of the invention can be understood, a detailed description of the invention may be had by reference to certain embodiments, some of which are illustrated in the accompanying drawings. It is to be noted, however, that the drawings illustrate only certain embodiments of this invention and are therefore not to be considered limiting of its scope, for the scope of the invention encompasses other equally effective embodiments. The drawings are not necessarily to scale, emphasis generally being placed upon illustrating the features of certain embodiments of the invention. In the drawings, like numerals are used to indicate like parts throughout the various views. Thus, for further understanding of the invention, reference can be made to the following detailed description, read in connection with the drawings in which.

DETAILED DESCRIPTION OF THE INVENTION

As modular materials with both high intrinsic microporosity and conductivity, conductive metal-organic frameworks (MOFs) are compelling candidate electrocatalyst materials. Conductive MOFs exhibit surface areas that are about ten times that of metal nanoparticles, and their conductivities are comparable to graphite. At high driving forces, the rate of gas-consuming reactions (such as $H_2O_2$ synthesis from $O_2$), are limited by the mass transport and solubility of gaseous species. These mass transport limitations fundamentally limit the observed current densities (rates of reaction) with conductive MOF electrodes, which translates to an underutilization of their active surface area.

This disclosure provides an electrode that overcomes mass transport limits by providing a gas diffusion pathway to a conductive MOF electrode. At the same applied potential, this translates to a tenfold improvement in current density (greater than 100 mA $cm^{-2}$) relative to conventional conductive MOF electrode geometries (less than 1 mA $cm^{-2}$).

For example, gas diffusion electrodes (GDEs) loaded with MOFs (e.g. a 2D-MOF) can sustain the electrosynthesis of $H_2O_2$ from $O_2$ and $H_2O$ to produce steady-state $H_2O_2$ streams with concentrations greater than 110 mM. The efficiency of a MOF-bearing GDE can be modulated by tuning the mass loading of the MOF on the GDE, and by incorporating hydrophobic components to manage catalyst layer flooding and improve gas transport during electrosynthesis.

Other examples of electrosynthesis reactions on gaseous substrates include the electroreduction of $CO_2$ or CO to alkenes (e.g. ethylene), alcohols (e.g. methanol, ethanol, propanol), acetates and formates. Further examples include reduction of NO or $N_2O$ to $NH_3$ and $N_2H_4$. Gaseous substrates further include oxidizable substrates such as $H_2$, $NH_3$, $N_2H_4$ and gaseous hydrocarbons. A gaseous substrate is a substrate that is in the gas phase at standard temperature and pressure (STP) of 273 K and 1 atmosphere.

Figure 1:
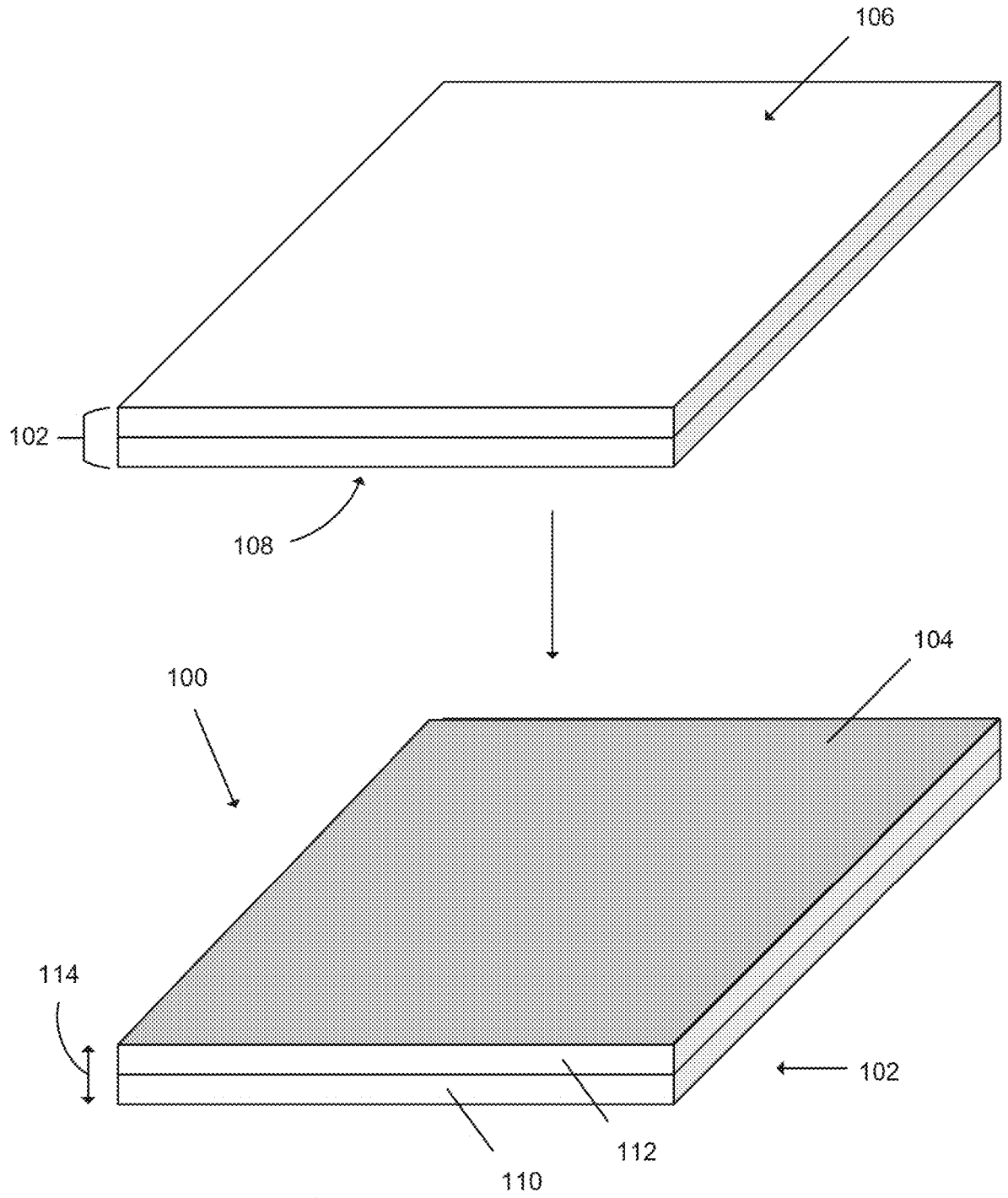
FIG. 1 is a schematic depiction of an electrode formed by coating a gas diffusion electrode (GDE) with a surface layer of a metal-organic framework (MOF)

FIG. 1 depicts an electrode 100 comprising a gas diffusion electrode (GDE) layer 102 and a metal-organic framework (MOF) layer 104. The GDE layer 102 has a top surface 106 and a bottom surface 108. The MOF layer 104 is disposed on the top surface 106 such that the MOF layer 104 is contiguous with the top surface 106. The MOF layer 104 may be deposited using a variety of conventional techniques including, but not limited to, drop casting, spin casting, spray-coating from suspension, doctor blading, direct solvothermal growth of the MOF film on the support and the like.

The GDE layer 102 comprises a porous layer 110 which provides the bottom surface 108. Examples of suitable porous layers are known in the art and include carbon cloth, carbon paper and the like. The porous layer 110 is contiguous with a hydrophobic layer 112. The hydrophobic layer 112 is typically a hydrophobic polymer such as a polyfluorinated polymer like polytetrafluoroethylene (PTFE) sold under the brand name TEFLON®. In one embodiment, the hydrophobic layer 112 is microporous. The MOF layer 104 is contiguous with the hydrophobic layer 112. Without wishing to be bound by any particular theory, the hydrophobic layer 112 is believed to repel water and thereby provide a gas diffusion pathway which permits dissolved gasses to travel through the porous layer 110, through the hydrophobic layer 112 and contact the MOF layer 104. This significantly reduces diffusion layer thicknesses during polarization. Shorter average diffusion lengths translate to large gas concentrations closer to the MOF surfaces, allowing for higher rates of electroreduction.

In one embodiment, the GDE layer 102 has a thickness 114 that is less than 0.5 mm. In another embodiment, the GDE layer 102 has a thickness that is less than 0.25 mm. In yet another embodiment, the GDE layer 102 has a thickness that is between 0.1 and 0.5 mm. The hydrophobic layer 112 may, for example, have a thickness between 0.01 mm and 0.2 mm with the balance of the GDE layer thickness being the porous layer 110. Suitable GDEs are commercially available from a variety of sources including AVCARB® in Lowell, Massachusetts, United States; SIGRACET® in Charlotte, North Carolina, United States, TORAY® in Tokyo, Japan and FREUDENBERG® in Weinheim, Germany.

The MOF layer 104 comprises metal ions coordinated to at least one organic linker to form an electrically conductive, a crystalline network. Composed of inorganic nodes and organic linkers ordered to create a crystalline network, conductive MOFs are materials that are both intrinsically porous and conductive. By virtue of their porosity, conductive MOFs possess very high surface areas (about 100s to 1000s of $m^2$ $g^{-1}$), providing numerous, molecularly-defined active sites for substrate activation.

Examples of suitable metal ions include nickel ions (e.g. $Ni^{2+}$), copper ions (e.g. $Cu^{2+}$), manganese ions (e.g. $Mn^{2+}$) and cobalt ions (e.g. $Co^{2+}$). Additional metal ions include those of Pt, Pd, Ag, La, Nd, Zn, Fe, Mg, Yb, Ho, Pb, Cd, Dy, Tb, Er, Lu, Gd. The organic linker may be, for example, a hexasubstituted triphenylene ligand such as 2,3,6,7,10,11-hexaiminotriphenylene (HITP), =2,3,6,7,10,11-triphenylenehexathiolate (THT) or 2,3,6,7,10,11-hexahydroxytriphenylene (HHTP). In another embodiment, the organic linker is tetrathiafulvalene tetrabenzoate (TTFTB). Additional organic linkers include 2,5-dioxidobenzene-1,4-dicarboxylate (DOBDC), 2,5-disulfidobenzene-1,4-dicarboxylate (DSBDC), 4,4'-(anthracene-9,10-diyl)bis(2-hydroxybenzoate (AnBHB), 1,2,3-triazolate, benzene-1,4-dipyrazolate (BDP), bis(1H-1,2,3-triazolo[4,5-b],[4,'5'-i]dibenzo[1,4]-dioxin (BTDD), dihydroxybenzoquinonate (dhbq), chloranilate (Cl2dhbq), nenzenehexathiolate (BHT), hexaiminobenzene (HIB), hexahydroxybenzene (HHB), 2,3,7,8,12,13-hexahydroxytetraazanaphthotetraphene (HHTT), hexaiminohexaazatrinaphthalene (HATN), metallophthalocyanine (M'(OPc)), metallonapthalocyanine (M'(ONpc), tetrathiafulvalene tetrapyridyl (TTF-(py)4), N,N'-di(4-pyridyl)-1,4,5,8-naphthalenetetracarboxdiimide (DPNDI). Methods of forming various MOFs are known in the art. Other suitable MOFs are contemplated for use with the disclosed electrodes and are considered within the scope of this disclosure.

The MOF layer 104 is deposited on the top surface 106 at a concentration of at least 0.01 mg $cm^{-2}$. In one embodiment, the concentration is between 0.01 mg $cm^{-2}$ and 5 mg $cm^{-2}$. In another embodiment, the concentration is between 0.1 mg $cm^{-2}$ and 1 mg $cm^{-2}$. In another embodiment, the concentration is between 0.2 mg $cm^{-2}$ and 0.8 mg $cm^{-2}$.

Figure 2A:
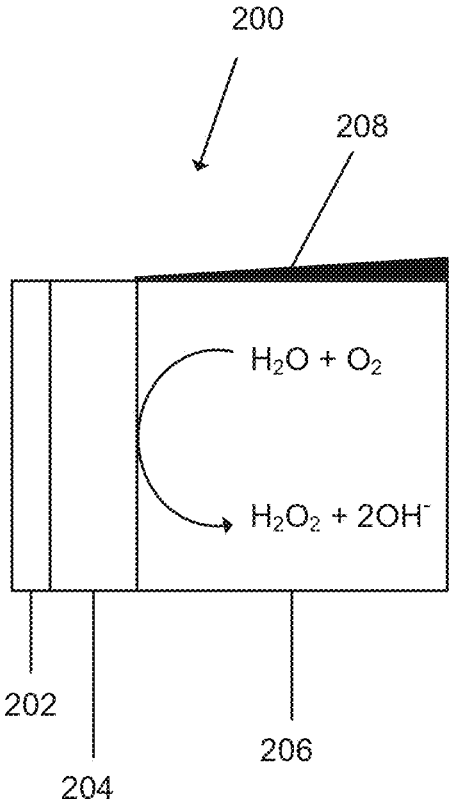
FIG. 2A depicts a MOF-bearing electrode showing gas diffusional gradient.

Referring to FIG. 2A, a MOF-bearing electrode 200 that lacks a GDE is shown. The electrode 200 comprises a glassy carbon electrode 202 and a MOF layer 204. A liquid 206 contacts the MOF layer 204. In the embodiment depicted in FIG. 2A, the liquid 206 comprises water and dissolved oxygen gas. Electrolysis reduces the oxygen gas to produce hydrogen peroxide and hydroxide. An oxygen gradient 208 is show that illustrates a decrease in oxygen availability near the MOF layer 204 surface due to mass transport limits.

Figure 2B:
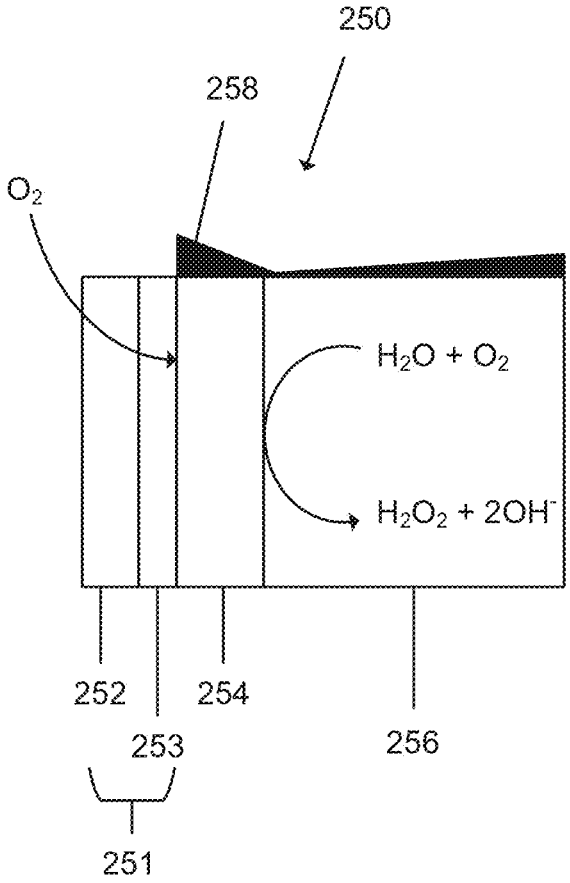
FIG. 2B depicts one embodiment of the disclosed electrode showing enhanced gas concentrations.

FIG. 2B depicts a MOF-GDE electrode 250 formed in accordance with this disclosure. The electrode 250 comprises a GDE layer 251 (with a porous layer 252 and a hydrophobic layer 253) and a MOF layer 254. A liquid 256 contacts the MOF layer 254. In the embodiment depicted in FIG. 2B, the liquid 256 comprises water and dissolved oxygen gas. Electrolysis reduces the oxygen gas to produce hydrogen peroxide and hydroxide. An oxygen gradient 258 is shown that illustrates an increase in oxygen availability near the MOF layer 254 surface.

For the electrosynthesis of $H_2O_2$ from $O_2$ reduction, reports have typically evaluated conductive MOFs by immersing a MOF-bearing electrode in solution (see Miner, E. M., Fukushima, T., Sheberla, D., Sun, L., Surendranath, Y. & Dincă, M. Electrochemical oxygen reduction catalysed by $Ni_3$(hexaiminotriphenylene)$_2$. Nat. Commun. 7, 10942 (2016)). The highest current densities reported have been about 1 mA $cm^{-2}$, despite application of relatively high overpotentials and the high intrinsic surface areas of these 2D-MOFs. The plateau at 1 mA $cm^{-2}$ results from the consumption of $O_2$ in solution, as $O_2$ exhibits a maximum solubility of about 1 mM in aqueous media. Consumption of $O_2$ during polarization leads to the development of large diffusion layer (depletion layer) thicknesses, which limits the rate of $O_2$ reduction to $H_2O_2$. The disclosed electrodes address this shortcoming as illustrated in the following experiments.

EXPERIMENTAL

Electrodes were interfaced with a microfluidic electrochemical cell with flowing electrolyte. See Ripatti, D. S., Veltman, T. R. & Kanan, M. W. Carbon Monoxide Gas Diffusion Electrolysis that Produces Concentrated C2 Products with High Single-Pass Conversion. Joule 3, 240-256 (2019). A commercial Pt/C electrode with flowing $H_2$ served as the anode to complete the electrochemical cell. As current flowed across the cell, $H_2O_2$ was dissolved into the electrolyte, which flowed into a vial at the cell outlet for quantification using an iodometric titration method. Both the anode and cathode were interfaced against a high-density, interdigitated flow field that supplied $H_2$ and $O_2$, respectively.

Figure 3:
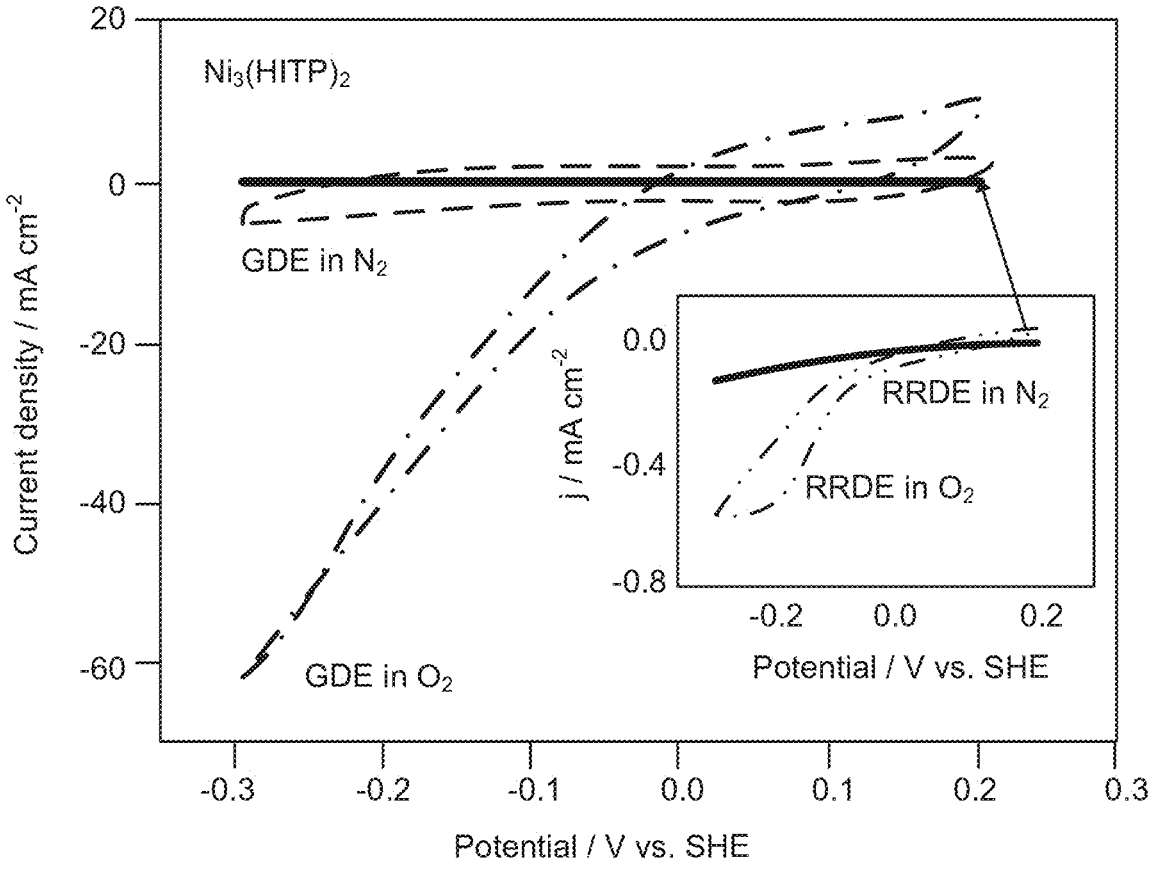
FIG. 3 shows cyclic voltammograms of electrodes (using a $Ni_3(HITP)_2$ MOF) on both (1) the disclosed MOF-GDE electrode and (2) a rotating ring disc electrode (RRDE) as a control.

FIG. 3 shows cyclic voltammograms (CVs) of electrodes (using a $Ni_3(HITP)_2$ MOF) on both (1) the disclosed MOF-GDE electrode and (2) a rotating ring disc electrode (RRDE) as a control. The CVs were obtained during $O_2$ electroreduction and $H_2O_2$ electrosynthesis.

MOF-GDE preparation: The MOF was $Ni_3(HITP)_2$ (HITP is 2,3,6,7,10,11-hexaiminotriphenylene) and was prepared according to literature methodology (Chen, T., Dou, J.-H., Yang, L., Sun, C., Libretto, N. J., Skorupskii, G., Miller, J. T. & Dincă, M. Continuous Electrical Conductivity Variation in $M_3$(Hexaiminotriphenylene)$_2$ (M=Co, Ni, Cu) MOF Alloys. J. Am. Chem. Soc. 142, 12367-12373 (2020). Catalyst inks consisting of a combination of 2D-MOF particles and an ionomer sold under the brand name NAFION® in alcohol solutions were ultrasonicated and drop-casted (0.4 mg $cm^{-2}$) onto GDE supports to form MOF-bearing GDEs (hereafter MOF-GDEs).

RRDE preparation: As a control, $Ni_3(HITP)_2$ (0.4 mg $cm^{-2}$) supported on glassy carbon in a rotating ring disk electrode (RRDE, hereafter MOF-RRDE) was immersed in a standard electrochemical cell containing electrolyte and saturated with $O_2$. The cyclic voltammograms indicated a plateau current of 0.4 mA $cm^{-2}$ for the MOF-RRDE.

The cyclic voltammograms of FIG. 3 indicated a high current density of about 62 mA $cm^{-2}$ at −0.29 V vs. SHE in $O_2$ atmosphere. The MOF-GDE exhibited negligible current densities in $N_2$ atmosphere, indicating the majority of the current observed in $O_2$ atmosphere arose from $O_2$ electroreduction. Polarization of the GDE support without added $Ni_3(HITP)_2$ (not shown in FIG. 3) indicated current densities of only about 0.1 mA $cm^{-2}$, indicating that the observed activity is that of the supported $Ni_3(HITP)_2$ MOF. The current densities observed using a MOF-GDE were 1-2 orders of magnitude higher than those exhibited by the MOF-RRDE.

Figure 4A:
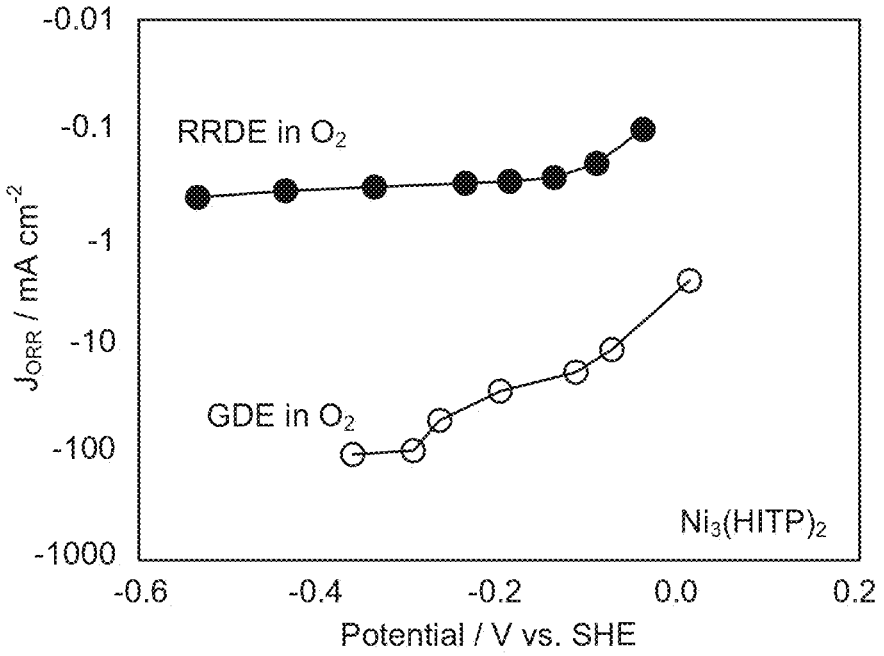
FIG. 4A depicts oxygen reduction rates (ORR) of oxygen gas for electrodes (using a $Ni_3(HITP)_2$ MOF) on both (1) the disclosed MOF-GDE electrode and (2) a RRDE as a control.

Referring to FIG. 4A, potentiostatic measurements were obtained, during which the potential of the MOF-bearing electrodes was stepped to progressively more negative potentials. In the MOF-GDE, a monotonic increase was observed in current density as the MOF-GDE was driven to more negative applied potentials, with a peak current density of 103 mA $cm^{-2}$ at −0.36 V vs. SHE. In contrast, the MOF-GDEs exhibited a plateau in current density of only about 0.4 mA $cm^{-2}$ even at a more negative potential of −0.54 V vs. SHE, translating to a about 255× difference between the MOF-GDE and MOF-RRDE. The increase in current density using MOF-GDEs is believed to be due to the rapid mass transport of $O_2$ to the MOF catalyst particles.

Figure 4B:
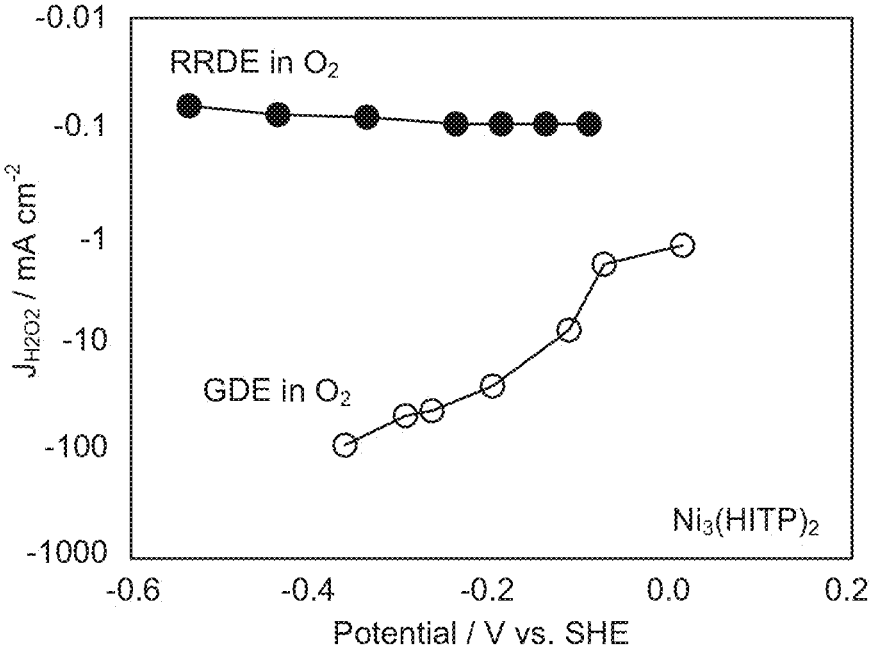
FIG. 4B depicts partial current densities ($j_{H2O2}$) of $H_2O_2$ electrosynthesis for electrodes (using a $Ni_3(HITP)_2$ MOF) on both (1) the disclosed MOF-GDE electrode and (2) a RRDE as a control.

Referring to FIG. 4B, differences in $H_2O_2$ electrosynthesis rates was more marked. At −0.36 V vs. SHE, 85% of the charge passed with the MOF-GDE contributed to the 2-electron reduction of $O_2$ to $H_2O_2$, with a partial current density ($j_{H2O2}$) of ~89 mA cm-2. This $j_{H2O2}$ in the MOF-GDE is about 740× higher than observed with a MOF-RRDE. In the MOF-GDE, this translated to a high $H_2O_2$ electrosynthesis rate of 1.66 mmol $cm^{-2}$ $hr^{-1}$. The remainder of the charge (15%) passed contributed to the 4-electron reduction of $O_2$ to $H_2O$. In $O_2$ atmosphere and with the electrolyte flowing at 0.2 mL $min^{-1}$, an outlet $H_2O_2$ concentration of 108 mM, or 0.33 wt % was measured. Moreover, with an $O_2$ flow rate to the inlet of 1.5 mL $min^{-1}$, a total current density of 103 mA $cm^{-2}$ translated to a $O_2$ conversion rate of 30%. The combination of high $O_2$ conversion and high $H_2O_2$ concentrations minimize feedstock and separation costs for an industrial process based on $H_2O_2$ electrosynthesis using MOF-GDEs.

Figure 5:
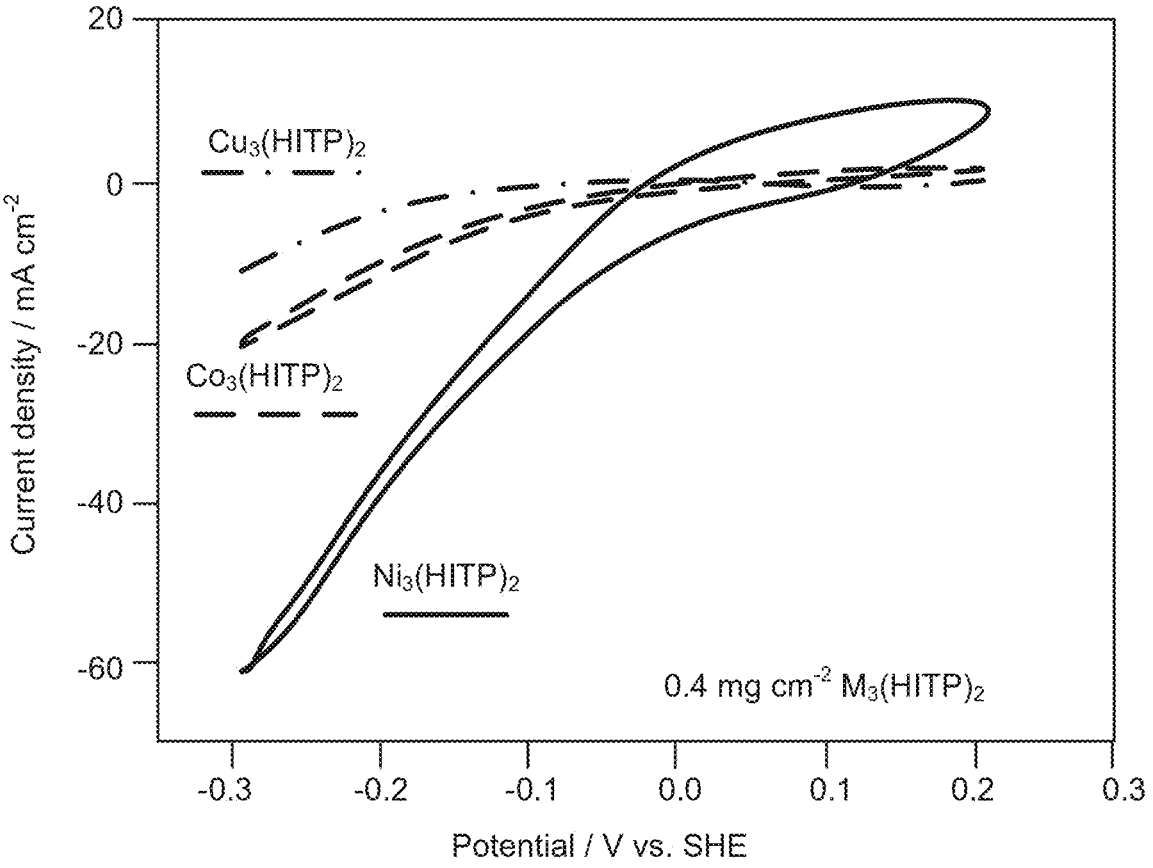
FIG. 5 shows cyclic voltammograms of the disclosed MOF-GDE electrodes using $Ni_3(HITP)_2$, $Cu_3(HITP)_2$ MOF and $Co_3(HITP)_2$ MOFs.
Figure 6A:
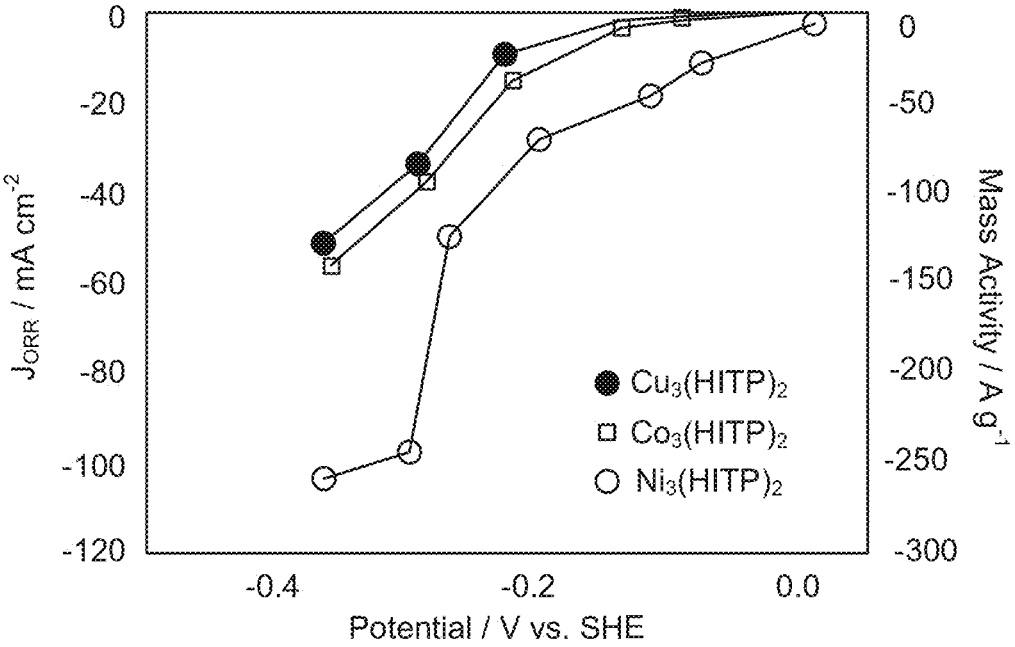
FIG. 6A depicts oxygen reduction rates (ORR) and mass activity of oxygen gas of the disclosed MOF-GDE electrodes using $Ni_3(HITP)_2$, $Cu_3(HITP)_2$ MOF and $Co_3(HITP)_2$ MOFs.
Figure 6B:
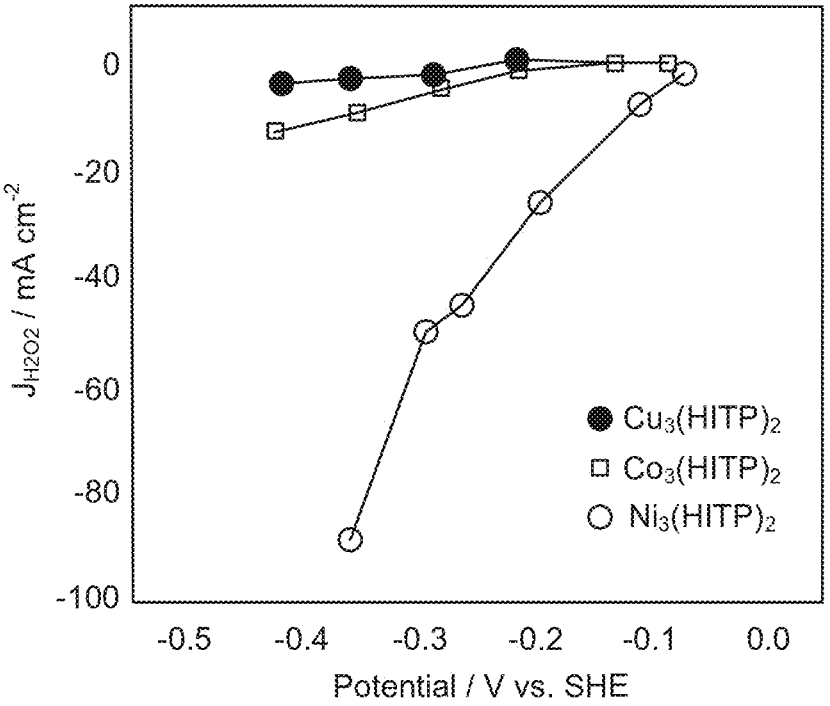
FIG. 6B depicts partial current densities ($j_{H2O2}$) of $H_2O_2$ electrosynthesis for the disclosed MOF-GDE electrodes using $Ni_3(HITP)_2$, $Cu_3(HITP)_2$ MOF and $Co_3(HITP)_2$, MOFs.

Integrating other MOFs beyond $Ni_3(HITP)_2$ into GDE supports is general. For example, FIG. 5 depicts cyclic voltammograms of Cu, Co, and Ni-based $M_3(HITP)_2$ MOFs at a mass loading of 0.4 mg $cm^{-2}$. FIG. 6A and FIG. 6B depict potentiostatic polarization data for all three $M_3(HITP)_2$ MOF-GDEs. Under potentiostatic conditions, both MOFs exhibited current densities greater than 20 mA $cm^{-2}$ at potentials more negative than −0.25 V vs. SHE, although the rates of $O_2$ reduction and $H_2O_2$ electrosynthesis were lower than with $Ni_3(HITP)_2$. For example, at −0.35 V vs. SHE, the observed total current densities for $Co_3(HITP)_2$ and $Cu_3(HITP)_2$ were 52 mA $cm^{-2}$ and 56 mA $cm^{-2}$, respectively. These values were about 50% of the current densities observed with $Ni_3(HITP)_2$. However, a smaller proportion of the current in $Co_3(HITP)_2$ and $Cu_3(HITP)_2$ contributed to $H_2O_2$ electrosynthesis, with $j_{H2O2}$ values that were less than 10% relative to those observed with $Ni_3(HITP)_2$. Given their lower $H_2O_2$ synthesis rates, $Co_3(HITP)_2$ and $Cu_3(HITP)_2$ GDEs would be more suitable for applications in which minimizing $H_2O_2$ production is important, as in fuel cells. More broadly, GDEs supporting diverse MOF chemistries enable high reaction rates for a variety of other gas consuming/forming reactions.

Figure 7A:
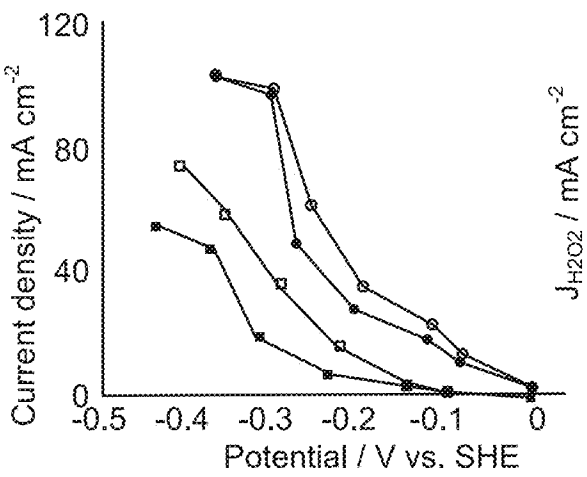
FIG. 7A is a graph showing current density of a MOF-GDE electrode at various mass loadings of a $Ni_3(HITP)_2$ MOF.
Figure 7B:
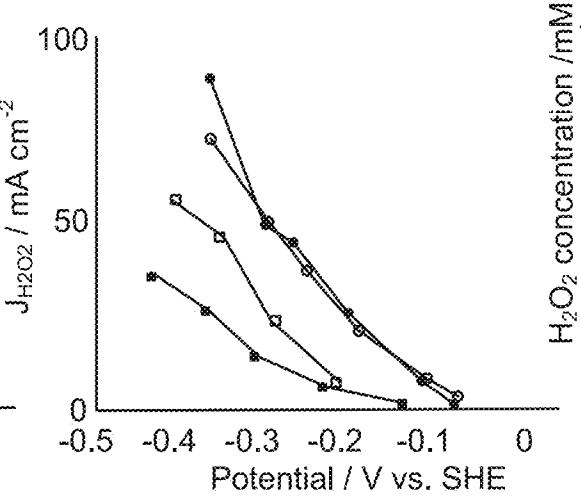
FIG. 7B is a graph showing partial current densities ($j_{H2O2}$) of $H_2O_2$ electrosynthesis for a MOF-GDE electrode at various mass loadings of a $Ni_3(HITP)_2$ MOF.
Figure 7C:
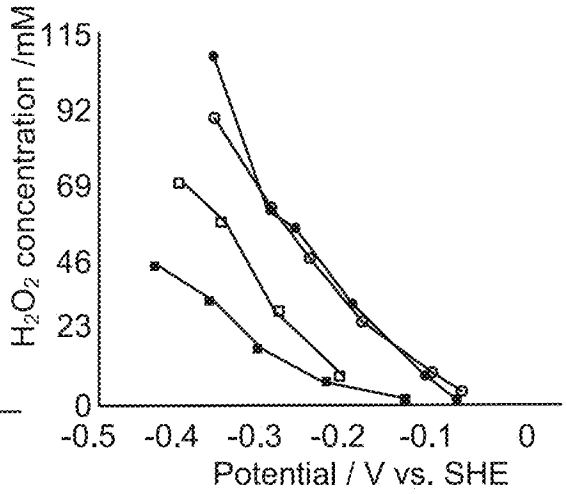
FIG. 7C is a graph depicting $H_2O_2$ concentration formed during oxygen electrolysis using various mass loading of a $Ni_3(HITP)_2$ MOF with a GDE.

FIG. 7A, FIG. 7B and FIG. 7C illustrate loading effects with $Ni_3(HITP)_2$ MOF-GDEs. FIG. 7A shows polarization behavior of four different loadings of $Ni_3(HITP)_2$ on GDEs. FIG. 7B shows partial current densities for $H_2O_2$ synthesis. FIG. 7C depicts outlet $H_2O_2$ concentrations for the four different electrodes.

Generally, increasing mass loading raised the observed current density of the MOF-GDE. As an example, $Ni_3(HITP)_2$ MOF-GDEs was prepared with systematically increasing mass loadings from 0.1 to 0.8 mg $cm^{-2}$ and their $O_2$ electroreduction performance was evaluated. The current densities increased with increased mass loading of $Ni_3(HITP)_2$, up to loadings at 0.4 mg $cm^{-2}$. These changes in total current density were accompanied by increases in $j_{H2O2}$ (FIG. 7B) and the outlet $H_2O_2$ concentration (FIG. 7C), with the lowest mass loading producing the least $H_2O_2$ across the range of applied potentials. However, the measured current density of a 0.8 mg $cm^{-2}$ electrode was very similar to that of a 0.4 mg $cm^{-2}$ $Ni_3(HITP)_2$ electrode, which may be due to electrode flooding. Electrode flooding likely increased the average diffusion layer thickness of $O_2$, depressing the observed current density despite the availability of additional active sites.

The observed $O_2$ reduction and attendant $H_2O_2$ electrosynthesis rates could be modulated by controlling the catalyst layer microstructure by increasing catalyst mass loading. Additionally, the rates could be increased by inclusion of hydrophobic additives in the catalyst ink. Small amounts of a hydrophobic additive (e.g. polytetrafluoroethylene (PTFE) powder) were incorporated into the catalyst ink and the amount of ionomer added was reduced by a corresponding amount. The hydrophobic particles are believed to self-assemble to create hydrophobic gas transport channels in the MOF layer. Other suitable hydrophobic additives include fluorinated ethylene propylene (FEP), partially hydrophobic ionomers such as a sulfonated tetrafluoroethylene based fluoropolymer-copolymer sold under the brand name NAFION®; a semi-crystalline fluoropolymer sold under the brand name AQUIVION®; an imidazolium functionalized styrene polymer sold under the brand name SUSTAINION® or a poly(aryl piperidinium) sold under the brand name PIPERION®.

Figure 8A:
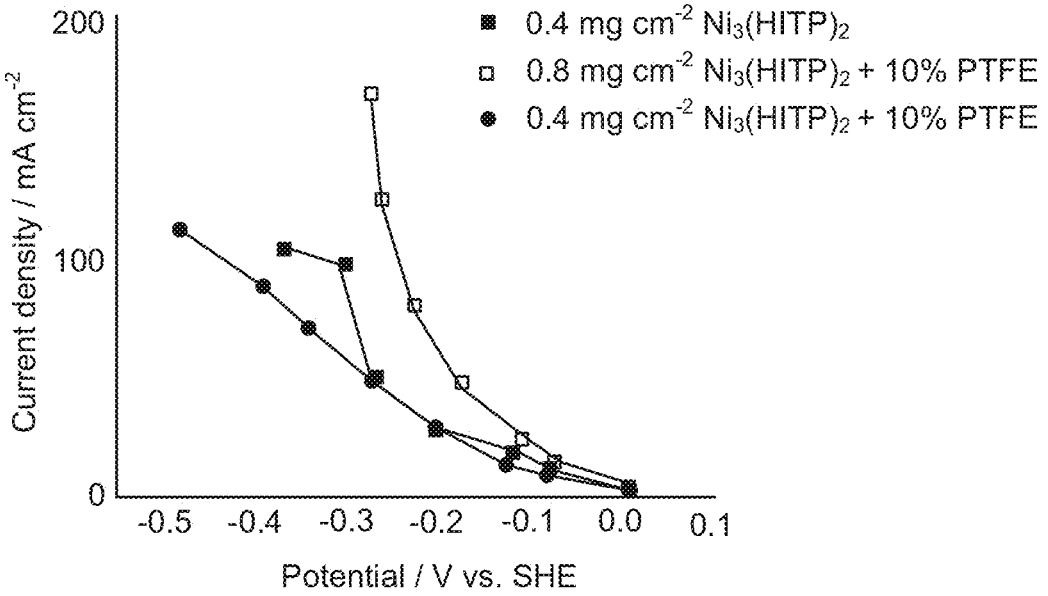
FIG. 8A is a graph of current density of a MOF-GDE electrode at various mass loadings of a $Ni_3(HITP)_2$ MOF with PTFE present.
Figure 8B:
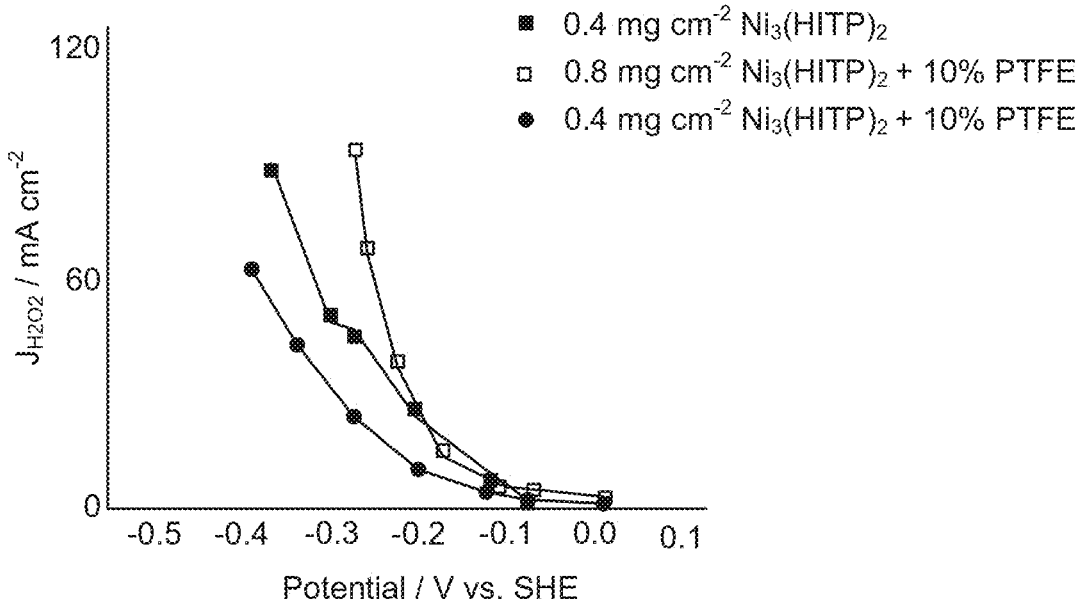
FIG. 8B is a graph showing partial current densities ($j_{H2O2}$) of oxygen gas for a MOF-GDE electrode at various mass loadings of a $Ni_3(HITP)_2$ MOF with PTFE present.

FIG. 8A and FIG. 8B illustrate modulation of electrosynthetic performance by adding PTFE. FIG. 8A shows total current densities for PTFE-modified electrodes. FIG. 8B shows partial current densities for $H_2O_2$ synthesis for PTFE-modified electrodes. With 10 wt % added PTFE, a MOF-GDE with 0.8 mg $cm^{-2}$ $Ni_3(HITP)_2$ exhibited significantly improved polarization behavior relative to MOF-GDEs with 0.4 mg $cm^{-2}$ of $Ni_3(HITP)_2$ both with and without added PTFE. The 0.8 mg $cm^{-2}$ $Ni_3(HITP)_2$ MOF-GDE with 10 wt % PTFE passed total current densities of about 170 mA $cm^{-2}$ at just −0.27 V vs. SHE, translating to a total inlet $O_2$ conversion rate of 48% at 1.5 mL $min^{-1}$ of $O_2$ flow. With a $j_{H2O2}$ of 93 mA $cm^{-2}$, this translated to a high concentration of 113 mM $H_2O_2$ at the cell outlet, or 0.38 wt %. By comparison, a PTFE-free 0.4 mg $cm^{-2}$ $Ni_3(HITP)_2$ electrode reached peak current densities of 103 mA $cm^{-2}$ at a 90 mV higher driving force of −0.36 V vs. SHE. Taken together, these indicate that the managing catalyst layer flooding and $O_2$ transport by incorporating PTFE particles can improve the efficiency of the MOF-GDE for electrosynthesis. Further optimization by controlling both the MOF and the PTFE wt % and particle size is likely to yield further improvements in performance.

Figure 9A:
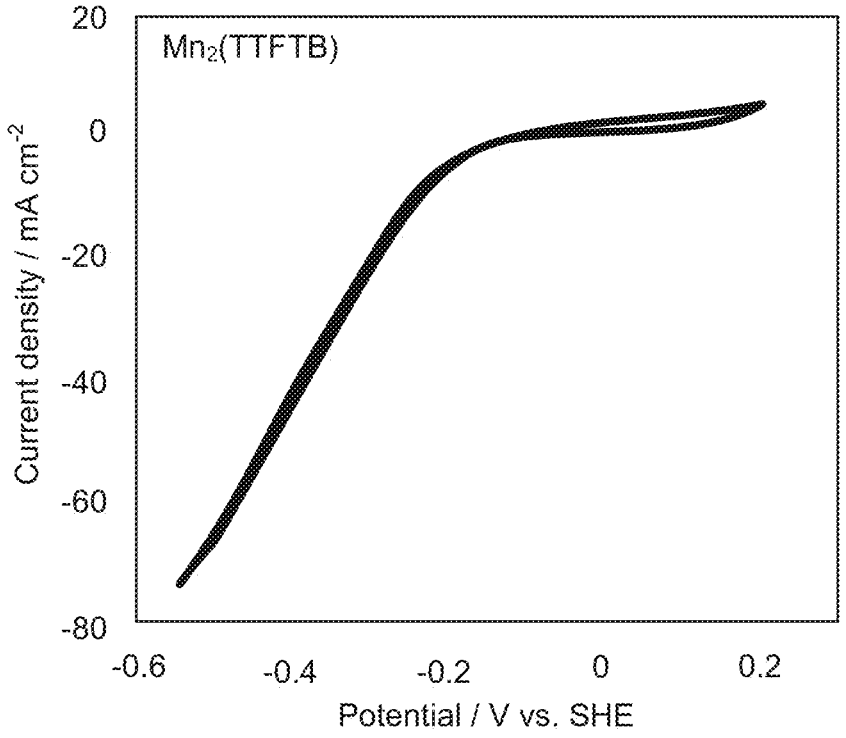
FIG. 9A is a cyclic voltammogram in 1 bar $O_2$ atmosphere of a MOF-GDE electrode made using $Mn_2$(TTFTB)
Figure 9B:
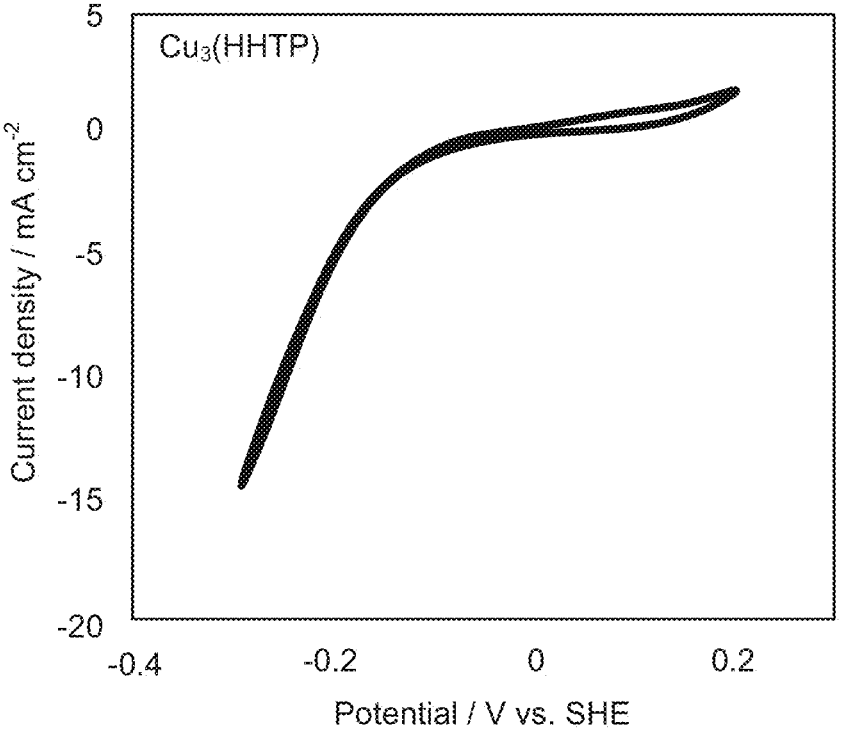
FIG. 9B is a cyclic voltammogram in 1 bar $O_2$ atmosphere of a MOF-GDE electrode made using $Cu_3(HHTP)_2$.

Additional metals and organic linkers may also be used. For example, FIG. 9A and FIG. 9B are cyclic voltammograms (CV) of a MOF-GDE electrode made using $Mn_2(TTFTB)$ (TTFTB=tetrathiafulvalene tetrabenzoate) and $Cu_3(HHTP)_2$ (HHTP=hexahydroxytriphenylene) respectively. These measurements were made at a mass loading of 0.4 mg $cm^{-2}$ for $Cu_3(HHTP)_2$ and 0.5 mg $cm^{-2}$ for $Mn_2(TTFTB)$ during a $H_2O_2$ electrosynthesis reaction as described elsewhere in this specification. The CV clearly demonstrates the successful reduction of $O_2$ by both electrodes.

Figure 10:
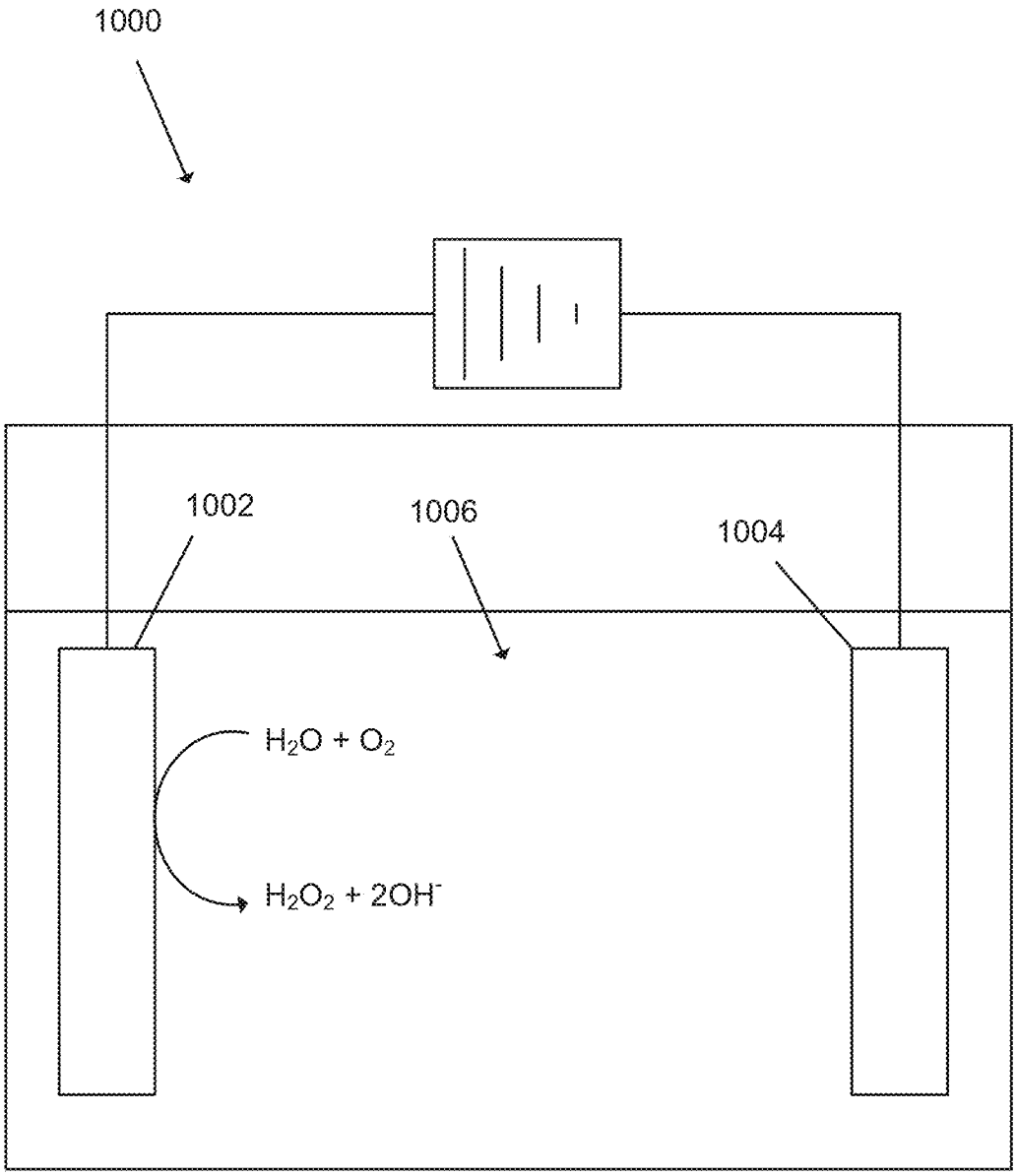
FIG. 10 is a schematic depiction of an electrochemical cell that utilizes a MOF-GDE electrode with different loading of PTFE.

FIG. 10 depicts an electrochemical cell 1000 that comprises a first electrode 1002 and a second electrode 1004. For example, the first electrode 1002 may be a cathode and the second electrode 1004 may be an anode. The first electrode 1002 is substantially identical to MOF-GDE electrode 250. The electrochemical cell 1000 also comprises a liquid electrolyte solution 1006. In the embodiment of FIG. 10, the electrochemical cell 1000 is used to reduce a gaseous substrate that is dissolved in the liquid electrolyte solution 1006 by providing electricity to the electrochemical cell. In FIG. 10, the gaseous substrate is oxygen gas and the liquid electrolyte solution 1006 comprises water and a suitable electrolyte. A wide variety of electrolytes are known in the art.

MOF-GDEs exhibit orders of magnitude higher current densities compared to MOFs simply supported on a nonporous conductive substrate and immersed in electrolyte, which is the predominant MOF electrocatalyst form factor employed at present. These higher current densities translate to high electrosynthesis rates of $H_2O_2$ from $O_2$ at neutral pH, producing product outlet streams with $H_2O_2$ concentrations greater than 100 mM.

The capability to support a variety of different MOF compositions and chemistries offers generalizability to other electrochemically driven gas-consuming and gas-forming reactions, the rates of which can strongly depend on the identity of the MOF supported on the GDE. Substituting one MOF for another also enables control over the product distribution of the reaction.

If powered using low-cost, renewable electricity and hydrogen, electrosynthesis of $H_2O_2$ is cost-competitive with existing processes to produce $H_2O_2$. More broadly, MOF-GDEs has relevance in gas-consuming, gas-separating, in situ disinfection and gas-forming reactions (such as $CO_2$ reduction to fuels and hydrocarbons, direct air capture of $CO_2$, and organic electrosynthesis).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An electrode comprising:

a metal-organic framework layer that forms a gas diffusion electrode layer;

a hydrophobic layer that consists of a hydrophobic polymer;

a porous layer that is contiguous with the hydrophobic layer; and wherein the hydrophobic layer is disposed between, and contiguous with, both the porous layer and the metal-organic framework layer, the metal-organic framework layer having an upper surface that is exposed.

2. The electrode as recited in claim 1, wherein the gas diffusion electrode layer has a thickness less than 0.5 mm.

3. The electrode as recited in claim 1, wherein the gas diffusion electrode layer has a thickness less than 0.25 mm.

4. The electrode as recited in claim 1, wherein the metal-organic framework layer comprises a metal-organic framework (MOF) formed from a metal ion coordinated to at least one organic linker and the MOF is a crystalline network.

5. The electrode as recited in claim 4, wherein the metal ion is a nickel ion, a copper ion, a manganese ion or a cobalt ion.

6. The electrode as recited in claim 5, wherein the organic linker is a hexasubstituted triphenylene ligand.

7. The electrode as recited in claim 5, wherein the organic linker is selected from a group consisting of hexaiminotriphenylene (HITP), tetrathiafulvalene tetrabenzoate (TTFTB) and hexahydroxytriphenylene (HHTP).

8. The electrode as recited in claim 4, wherein the MOF is present on the upper surface at a concentration of at least 0.1 mg per square cm.

9. The electrode as recited in claim 4, wherein the metal ion is a nickel ion.

10. The electrode as recited in claim 9, wherein the organic linker is hexaiminotriphenylene (HITP).

11. The electrode as recited in claim 1, wherein the metal-organic framework layer further comprises a hydrophobic polymer.

12. An electrochemical cell comprising the electrode as recited in claim 1.

13. A method for performing electrolysis, the method comprising:

introducing a gaseous substrate into an electrochemical cell;

providing electricity to the electrochemical cell, wherein the electrochemical cell comprises:

a first electrode comprising (1) a metal-organic framework layer that forms a gas diffusion electrode layer; (2) a hydrophobic layer that consists of a hydrophobic polymer; and (3) a porous layer that is contiguous with the hydrophobic layer; wherein the hydrophobic layer is disposed between, and contiguous with, both the porous layer and the metal-organic framework layer, the metal-organic framework layer having an upper surface that is exposed;

a second electrode; and a liquid electrolyte solution, the gaseous substrate being dissolved in the liquid electrolyte solution.

14. The method as recited in claim 13, wherein the metal-organic framework layer comprises a metal-organic framework (MOF) formed from a metal ion coordinated to at least one organic linker and the MOF is a crystalline network.

15. The method as recited in claim 14, wherein the gaseous substrate is oxygen and the liquid electrolyte solution comprises water.

16. The method as recited in claim 14, wherein the metal ion is a nickel ion.

17. The method as recited in claim 16, wherein the organic linker is hexa minotriphenylene (HITP).

18. The method as recited in claim 13, wherein the metal-organic framework layer further comprises a hydrophobic polymer.

19. The method as recited in claim 13, wherein the gaseous substrate is carbon dioxide or carbon monoxide.

20. The electrode as recited in claim 1, wherein the porous layer is carbon cloth or carbon paper.

* * * * *